United States Patent [19]

Fischetti

[11] Patent Number: 4,638,619

[45] Date of Patent: Jan. 27, 1987

[54] WOOD I-JOIST AND METHOD OF FABRICATING THE SAME

[76] Inventor: David C. Fischetti, 903 W. Maynard Rd., Cary, N.C. 27511

[21] Appl. No.: 563,181

[22] Filed: Dec. 19, 1983

[51] Int. Cl.[4] ..... E04C 3/30

[52] U.S. Cl. ..... 52/729; 52/690

[58] Field of Search ..... 52/729, 726, 690, 692, 52/730; 29/155 R

[56] References Cited

U.S. PATENT DOCUMENTS

| | | | |
|---|---|---|---|
| 2,230,628 | 2/1941 | Sahlberg | 52/729 X |
| 3,991,535 | 11/1976 | Keller et al. | 52/690 X |

FOREIGN PATENT DOCUMENTS

| | | | |
|---|---|---|---|
| 253185 | 7/1966 | Austria | 52/729 |
| 570650 | 9/1958 | Belgium | 52/729 |
| 101084 | 2/1965 | Denmark | 52/729 |
| 897622 | 10/1953 | Fed. Rep. of Germany | 52/729 |
| 140019 | 4/1953 | Sweden | 52/729 |

*Primary Examiner*—Carl D. Friedman
*Assistant Examiner*—Naoko N. Slack
*Attorney, Agent, or Firm*—Mills & Coats

[57] ABSTRACT

The present invention entails a wood I-joist and method of manufacturing and fabricating the same. Structurally the wood I-joist comprises a web assembly secured between two wood flange assemblies. Each wood flange assembly comprises a plurality of individual wood members secured together in end-to-end relationship to form an elongated wooden member subassembly that extends the entire length of each respective wood flange assembly. A series of wood member subassemblies are glued together in side-by-side relationship to form a respective wood flange assembly. In forming each wood flange assembly, an inner side is provided for receiving the web assembly. Each inner side is formed by providing an opening or void that stretches the entire length of each wood flange assembly to secure the web assembly within this opening or void. There is provided a number of wood wedge members which are driven into the web receiving opening, between each side of the web and an adjacent side of the wood flange assembly. The presence of these wood wedge members binds the web assembly and secures the same within the respective wood flange assemblies.

9 Claims, 5 Drawing Figures

WOOD I-JOIST AND METHOD OF FABRICATING THE SAME

FIELD OF INVENTION

The present invention relates to fabricated wood timbers and more particularly to fabricated wood I-joists.

BACKGROUND OF INVENTION

Fabricated wood I-joists are known and are commercially available. Generally such fabricated wood I-joists are often designed wherein a plywood web is supported between wood flanges. Typically the wood flanges are manufactured by gluing elongated wood laminates together. In manufacturing such wood flanges, it is common to find that the individual wood members or laminates are relatively thin and extend through a substantial span of the joist. Each individual wood member or laminate is secured to another wood laminate in face-to-face relationship by glue. Consequently the wood flanges are face glued. Therefore, to form a relatively large I-joist in cross section, many laminations are required and a substantial amount of glue is used. Further it is appreciated that a great amount of energy is required simply to make the laminates used in such I-joists. Because of this, such wood I-joists tend to be expensive and can involve complicated and time consuming manufacturing processes.

Moreover, in the manufacturing and construction of fabricated wood I-joists, little or no attention has been given to the selective use and location of various grade lumber to yield a more economical joist. In reality, laminated joists of the prior art have been manufactured with a single grade of wood laminate throughout. It is appreciated that this results in certain areas of the wood I-joist being structurally overdesigned with respect to the loading that such can be expected to carry. Thus, it is appreciated that this practice results in the wood I-joist costing more than would be required if the wood I-joist was designed such that higher grade lumber was only used in strategic areas that required such.

Given the fact that fabricated wood I-joists are being used and are going to continue to be used in construction, there is a need to develop new and improved design approaches that minimize total cost but which provide proper structural design.

SUMMARY AND OBJECTS OF PRESENT INVENTION

The present invention entails an improved wood I-joist having upper and lower wood flange assemblies secured between a web assembly. Each wood flange assembly is formed from a plurality of individual wood members that include both face and edge glue joints. More particularly respective wood flange assemblies are laminated by gluing respective wood members together in face-to-face and edge-to-edge relationship to form a wooden member subassembly that is generally the length intended for the flange. It should be pointed out that the individual wood members comprising the wood member subassemblies are generally square in cross section, for example, one-half inch by one-half inch. The formed wood member subassemblies are then glued together in side-by-side relationship (face and edge glued) to form a respective wood flange assembly. In forming the inner side or the side that faces the web assembly, the wood flange assemblies are designed to include an elongated opening for receiving the web assembly. More particularly, this elongated opening is actually formed by the placement and arrangement of wood member subassemblies along the inner side of the respective wood flange assemblies. This is accomplished by particularly spacing apart two adjacent wood member subassemblies so as to form a space with an open width greater than the thickness of the web assembly in order that the same can be inserted into the formed opening. This enables the web assembly to be inserted into this opening and consequently allows the same to be easily secured to the respective wood flange assemblies.

The present invention envisions the use of wood members that are generally square in cross section and further provides a process where the same is used to the extent that they are actually glued or secured together in end-to-end relationship. This is to be contrasted with conventional processes wherein the individual laminates used are only generally face glued. The advantage of the present design is that various areas of the wood flange assembly can be provided with a select grade of wood material that is capable of carrying specific design loads which these particular areas are expected to be exposed to. Other areas of the wood I-joist that are not subjected to these same magnitudes of loading or stress can be provided with lower grade wood material which will generally be more economical than higher grade wood material. Therefore, the present design lends itself to a more economical and practical design approach for wood I-joists.

In addition by the very nature of the individual wood laminates, the amount of glue and the number of glued joints are significantly reduced for wood I-joists of the same size.

It is, therefore, an object of the present invention to provide an improved fabricated wood I-joist that minimizes glue joints and the amount of glue utilized for a certain size and span of joist.

Still a further object of the present invention resides in the provision of a fabricated wood I-joist that includes upper and lower wood flange assemblies that are formed of laminated members but wherein the respective wood flange assemblies include both face and edge glued joints.

Another object of the present invention resides in the provision of a wood I-joist of a design type that lends itself to the select utilization of various grade wood material in certain select areas of the wood I-joist.

Still a further object of the present invention resides in the provision of a fabricated wood I-joist that includes upper and lower wood flange assemblies secured about opposite edges of a web assembly wherein each wood flange assembly comprise a plurality of elongated wood member subassemblies that extend the entire length of the respective wood flange assembly and wherein each wood member subassembly comprises a plurality of individual wood members, generally square in cross section, secured together in face-to-face or edge-to-edge relationship.

Another object of the present invention resides in the provision of a fabricated wood I-joist of a design that lends itself to a relatively simple and economical production and manufacturing process.

It is also an object of the present invention to provide a wood I-joist of the character referred to above that includes an improved method and means for securing a web assembly to the respective wood flange assemblies that form a part of the I-joist of the present invention.

Other objects and advantages of the present invention will become apparent from a study of the following description and the accompanying drawings which are merely illustrative of the present invention.

FABRICATED WOOD I-JOIST AND METHOD OF MANUFACTURING THE SAME

Figure 1:
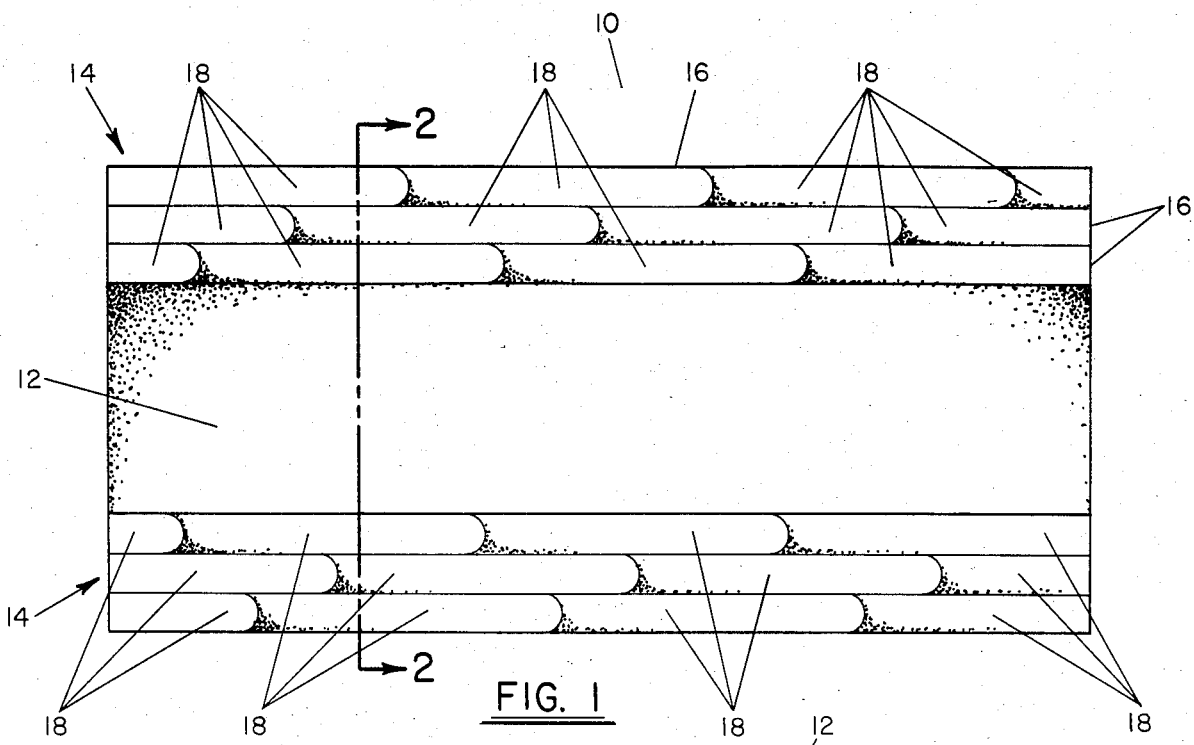
FIG. 1 is a side elevational view of the fabricated wood I-joist of the present invention.
Figure 2:
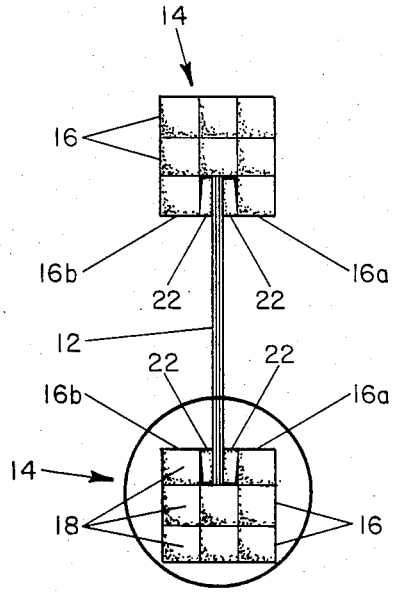
FIG. 2 is a cross sectional view of the I-joist taken through lines 2—2 of FIG. 1.

With further reference to the drawings, the fabricated wood I-joist of the present invention is shown therein and indicated generally by the numeral 10.

Wood I-joist 10 includes a web or gusset assembly, indicated generally by the numeral 12, interposed and connected between upper and lower wood flange assemblies, each wood flange assembly being generally indicated by the numeral 14.

In the case of the present disclosure, the web assembly shown is of a plywood construction. It should be appreciated, however, that other types of webs, such as hardboard or metal webs, could be used.

Attention is directed to the design and fabrication of wood flange assembly 14. In the case of the present invention, the same includes a plurality of elongated wood member subassemblies indicated generally by the numeral 16. Each wood member subassembly 16 stretches and extends the entire length of the wood I-joist 10 and is fabricated and made by joining in face-to-face and edge-to-edge relationship a plurality of individual wood members 18. Individual wood members 18 are of a generally uniform cross sectional area and in the present disclosure are shown to be generally square in cross section. Typically, one can contemplate that the individual wood members 18 would be approximately one-half inch by one-half inch or some other even multiple of standard lumber sizes. In the way of example, it is appreciated that in certain design applications that the individual wood members 18 could be of one-fourth inch stock, one-half inch stock, one inch stock, two inch stock, four inch stock, etc.

Figure 4:
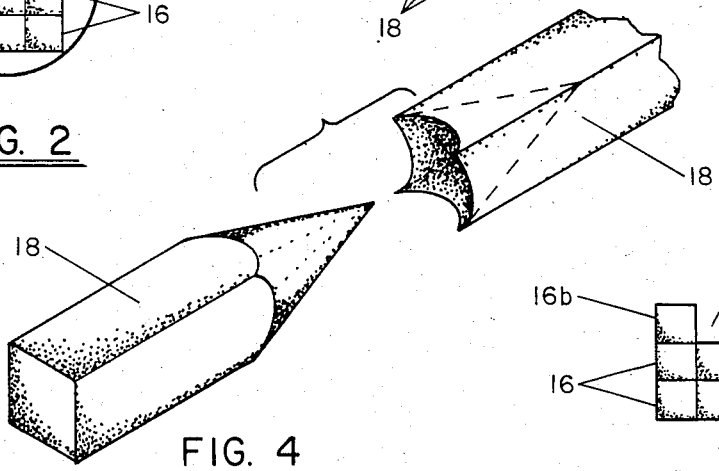
FIG. 4 is a fragmentary perspective view illustrating a pencil type end joint for receiving individual wood members together in end-to-end relationship.

To secure the respective wood members 18 in end-to-end relationship, it is contemplated that the same can be provided and designed so as to create pencil point joints, such as illustrated in FIG. 4. A pencil point joint is created and provided for by machining one end of respective wood members 18 to form to a protruding conical shape while machining or forming other ends of the respective wood members 18 to form a conical cavity for receiving the protruding conical ends. To facilitate the securement of the respective wood members 18 in end-to-end relationship, glue can be applied to the respective end surfaces. It is appreciated that the respective wood member subassemblies 16 extend from one end of the respective wood flange assembly 14 to the other end.

The next step in forming the respective wood flange assemblies 14 is to secure a plurality of said wood member subassemblies 16 in side-by-side relationship by face and edge gluing. Therefore, it is appreciated that when viewed in cross section that the respective wood flange assemblies comprise a series of wood members 18 that are effectively secured together by glue or other suitable securing means.

Each wood flange assembly 14 includes an inner side **14*a* that faces web assembly 12 when the web assembly 12 is secured therebetween. Formed about inner side 14*a* is a web receiving opening or void 20 that includes an open width greater than the thickness of web assembly 12. Web receiving opening 20 is specifically formed in the wood flange assembly 14 by particularly spacing a pair of wood member subassemblies 16*a* and 16*b* apart. This is particularly illustrated in FIGS. 3 and 5 of the drawings. Consequently, it is appreciated that the outer edge portions of web assembly 12 can be inserted directly to web receiving opening 20**.

Figure 3:
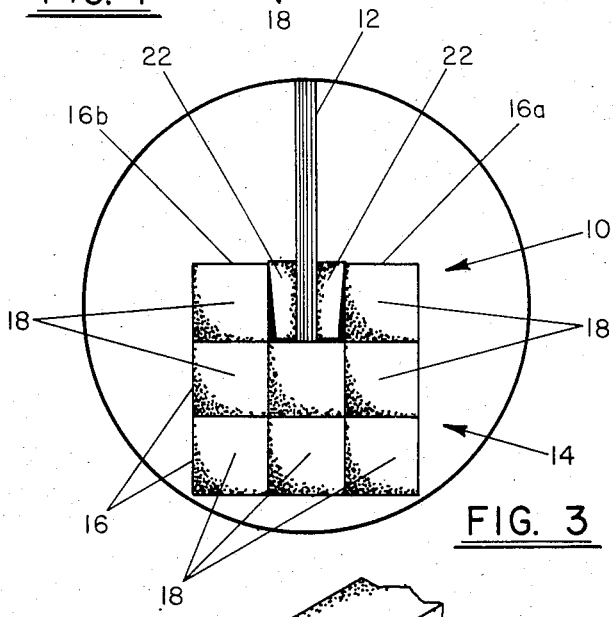
FIG. 3 is an enlarged cross sectional view of a wood flange assembly forming a part of the I-joist of the present invention.
Figure 5:
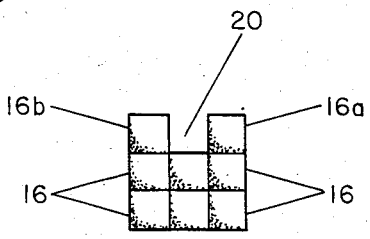
FIG. 5 is a cross sectional view of a wood flange assembly illustrating a formed opening for receiving an edge of a web assembly.

In the present disclosure, web assembly 12 is secured within web receiving opening 20 by a plurality of wedges 22. Specifically the respective wedges 22 are driven between the web assembly 12 and an adjacent wood member subassembly **16*a* or 16*b* as illustrated in FIGS. 3 and 5. To facilitate insertion of the wedges 22, it is contemplated that the same could include a tapered entry end. Also to secure web assembly 12 within opening 20, it is contemplated that glue could be applied in and around the wedges 22, web assembly 12 and the surrounding structure of the wood member subassemblies 16*a* and 16*b***.

In the example illustrated in FIGS. 1 through 5, it is appreciated that if the wood member subassemblies 16 are one-half inch by one-half inch in cross section that to accept a web assembly 12 of one-quarter inch thickness that the respective wedges 22 would have a nominal cross sectional area of slightly less than one-eighth inch by one-half inch. Obviously, the size of the wood members 18 can vary according to application.

From the foregoing specification and discussion, it is appreciated that the wood flange assemblies 18 include both face and edge glue joints. By selectively utilizing certain grades of materials at certain locations within the respective wood flange assemblies 14, it is appreciated that an improved economical I-joist design can be provided. This is especially true since a higher grade lumber or wood material that can support greater loads can be selectively located at places within the joist structure where such strength is required. In other areas that require less strength, a lower grade and more economical wood material can be utilized. Consequently, this provides a more economical joist design over conventional fabricated wood I-joist that includes the same type and grade of laminated wood elements throughout. Moreover, because of the basic design approach with respect to the utilization of square wood members as constructed with micro-laminations, the amount of glue and the number of glue joints for a given size of I-joist is reduced. Again all of these features contribute to the overall economics of the improved I-joist design of the present invention.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A fabricated wood I-joist comprising: upper and lower elongated wood flange assemblies, each wood flange assembly including a plurality of elongated wood member subassemblies with each wood member subassembly comprising a series of individual elongated wood members disposed in end-to-end relationship and which includes uniform and generally square cross sectional areas; means for securing the individual wood members together in end-to-end relationship to form respective elongated wood member subassemblies, said securing means including glue applied between respective ends of the generally square individual wood members for securing the wood members together in end-to-end relationship; means for securing said elongated wood members subassemblies together in side-by-side relationship to form a respective wood flange assembly having a cross sectional area comprised of a series of said generally square wood members, said means for securing said elongated wood member subassemblies together in face-to-face and edge-to-edge relationship including glue applied between respective wood member subassemblies; each formed wood flange assembly including an inner side having two spaced apart wood member subassemblies that define and naturally form an elongated web receiving opening therebetween; an elongated web assembly disposed between said inner sides of said elongated wood flange assemblies and wherein said web assembly has a thickness less than the width of said openings formed about the inner side of the respective wood flange assemblies; said elongated web assembly including two outer edge portions that extend into the respective web receiving openings formed about the inner sides of said respective wood flange assemblies; a plurality of wedge members driven between the outer edge portions of said web assembly on each side thereof and the adjacent wood member subassemblies that form said web receiving openings so as to bind said web assembly within said web receiving opening formed on inner sides of the respective wood flange assemblies; and glue provided about said wedge members, web, and surrounding wood member subassemblies for securing said web assembly within the respective wood flange assemblies.

2. The fabricated wood I-joist of claim 1 wherein said web assembly includes a plywood assembly that is secured between said upper and lower flange assemblies.

3. A fabricated I-joist comprising: upper and lower elongated wood flange assemblies, each wood flange assembly including a plurality of elongated wood member subassemblies that extend throughout the length of each wood flange assembly and which include a series of individual elongated wood members secured together in end-to-end relationship; means for securing the individual wood members together in end-to-end relationship to form respective elongated wood member subassemblies, said securing means including glue applied between respective ends of the individual wood members for securing the same together in end-to-end relationship; means for securing said formed elongated wood member subassemblies together in side-by-side relationship to form a respective wood flange assembly having a cross sectional area comprised of a series of said individual wood members, said means for securing said elongated wood member subassemblies together in side-by-side relationship including glue applied between respective wood member subassemblies; each formed wood flange assembly including an inner side having two spaced apart wood member subassemblies that define and naturally form an elongated web receiving opening therebetween; an elongated web assembly disposed between said inner sides of said elongated wood flange assembly wherein said web assembly has a thickness less than the width of each of said openings formed about the inner side of the respective wood flange assemblies; said elongated web assembly including two outer edge portions that extend into the respective formed web receiving openings formed about the inner sides of said respective wood flange assemblies; and means for securing the outer edge portions of said web assembly in and to said web receiving openings of said wood flange assemblies formed by the spacing of said two elongated wood member subassemblies apart so as to form an integral fabricated wood I-joist having a pair of upper and lower wood flange assemblies comprised of both face and edge glued wood members and wherein the respective wood flange assemblies are specifically designed and formed with said web receiving openings existing specifically to receive said web assembly, said means for securing said plywood web in said web receiving opening of the respective wood flange assemblies including wedge means that are driven into said web receiving opening between each side of said web assembly and an adjacent elongated wood member subassembly forming said web receiving opening so as to securely bind said web assembly between said wedge means.

4. The fabricated wood I-joist of claim 2 wherein said means for securing said web assembly in said web receiving opening further includes glue that is applied around said wedge means to secure the same to said web assembly and adjacent structure of said wood flange assembly.

5. The fabricated wood I-joist of claim 2 wherein said wedge means includes a plurality of wedge members and wherein each web member includes an entry portion that facilitates the insertion of the wedge members between said web assembly and an adjacent elongated wood member subassembly.

6. The fabricated wood I-joist of claim 2 wherein the respective individual elongated wood members comprising said elongated wood member subassemblies are generally square in cross section and wherein the cross sectional area of the respective individual wood members are generally uniform throughout their entire length.

7. The fabricated wood I-joist of claim 6 wherein said means for securing said individual wood members together in end-to-end relationship further comprise pencil point joints formed by forming selective ends of said wood members in a protruding conical shape while forming other selected ends of respective wood members in the shape of a conical cavity to receive respective protruding conical shaped ends.

8. A method of forming a prefabricated wood I-joist comprising the steps of: forming a plurality of elongated wood member subassemblies by gluing and securing a plurality of individual wood members, having a generally uniform and generally square cross sectional area, together in end-to-end relationship; gluing and securing said formed elongated wood member subassemblies together in side-by-side relationship to form upper and lower elongated wood flange assemblies, each wood flange assembly being comprised in cross sectional area of a plurality of said generally square individual wood members; forming an inner side for each wood flange assembly by providing two elongated wood member subassemblies in spaced apart relationship so as to define and naturally form an elongated opening between the two spaced apart elongated wood member subassemblies; mounting a web assembly between the two inner sides of said upper and lower wood flange assemblies by inserting opposite outer edge portions of said web assembly into said web receiving opening formed about the inner side of said wood flange assemblies; and securing each outer edge portion of said web assembly into said web receiving opening so as to form an integral wood I-joist comprised of said web assembly secured between the inner sides of said wood flange assemblies and wherein the wood flange assemblies include both face and edge glue joints and wherein respective elongated wood member subassemblies comprise a plurality of individual wood members joined end to end and wherein the same wood member subassemblies are secured together in side-by-side relationship, the step of securing respective outer edge portions of said web assembly in and to said web receiving openings including the step of driving wooden wedge members into said web receiving openings between each side of said plywood web and adjacent respective wood member subassemblies forming said web receiving opening.

9. The method of forming a wood I-joist as recited in claim 8 wherein the step of securing said web assembly in and to said web receiving opening further includes the step of applying glue to said wedge members, web assembly, and the surrounding structure of said wood flange assembly so as to effectively glue said web assembly within said web receiving opening.

* * * * *